US005836105A

United States Patent [19]

Loosen

[11] Patent Number: 5,836,105

[45] Date of Patent: Nov. 17, 1998

[54] NURSERY POT STABILIZING DEVICE

[75] Inventor: Ronald E. Loosen, Temecula, Calif.

[73] Assignee: Amaroo Enterprises, Inc., Temecula, Calif.

[21] Appl. No.: 853,832

[22] Filed: May 9, 1997

[51] Int. Cl.[6] ..... A47G 7/00

[52] U.S. Cl. ..... 47/39; 248/154; 248/156

[58] Field of Search ..... 47/39, 71; 248/154, 248/156, 545

[56] References Cited

U.S. PATENT DOCUMENTS

| | | | |
|---|---|---|---|
| 737,581 | 9/1903 | Chapman . | |
| 942,177 | 12/1909 | Keitsch . | |
| 1,357,777 | 11/1920 | Hastings | 47/39 |
| 1,846,433 | 2/1932 | Morley . | |
| 1,902,423 | 3/1933 | Seltzer . | |
| 2,861,764 | 11/1958 | Fisher . | |
| 5,279,070 | 1/1994 | Shreckhise et al. . | |

FOREIGN PATENT DOCUMENTS

| | | | |
|---|---|---|---|
| 558851 | 9/1923 | France | 47/39 |
| 1148341 | 12/1957 | France . | |
| 2297543 | 8/1976 | France | 47/39 |
| 2481881 | 11/1981 | France | 47/39 |
| 2557761 | 7/1985 | France | 47/39 |
| 1058528 | 2/1967 | United Kingdom . | |
| 2147495 | 5/1985 | United Kingdom | 248/154 |

*Primary Examiner*—Michael J. Carone
*Assistant Examiner*—Joanne C. Downs
*Attorney, Agent, or Firm*—Knobbe, Martens, Olson & Bear, LLP

[57] ABSTRACT

A device for holding and stabilizing nursery pots to protect against blowover from wind and rain. The device comprises a circular base having a central cavity, upwardly extending vertical projections attached to the base and openings between the vertical projections for placement of stakes for securing the device above the ground. The device may further include a ring encircling and attached to the vertical supports for added stabilization.

13 Claims, 2 Drawing Sheets

NURSERY POT STABILIZING DEVICE

FIELD OF THE INVENTION

The present invention relates to a pot stabilizer for use in the nursery industry. More specifically, the invention relates to an easily movable article situated above ground with positive above ground anchoring and an air gap for root pruning.

BACKGROUND OF THE INVENTION

In a plant nursery, potted flowers, shrubs and trees are subject to blowover due to wind. In addition, such potted plants may be inadvertently toppled due to contact with humans, animals, carts, machinery and the like. Several techniques have been used to address the problem of plant blowover. One such technique is the use of guide wires. These guide wires, however, make it difficult to move around in the area containing the plants and don't allow easy mobility of the article.

U.S. Pat. No. 1,846,433 discloses a flower and plant holder containing an inner container, which may be anchored into the ground with a center stake, and an outer ornamental holder. U.S. Pat. No. 1,902,423 describes a flower holding device comprising a metal frame ring having openings therein through which are placed anchor rods for stabilization of the flower pot and protection against displacement by wind. U.S. Pat. No. 2,861,764 discloses a support means for utility and/or ornamental receptacles customarily displayed on lawns.

The "Grip-Lip" pot-in-pot system sold by Nursery Supplies, Inc. (Chambersburg, Pa.) comprises an inner pot which is placed in the ground and an outer pot containing the plant which is placed inside the inner pot.

U.S. Pat. No. 5,279,070 discloses a plant growing receptacle which allows nesting of a nursery pot therein. The receptacle is anchored to the ground by drainage materials placed at its bottom. The receptacle may be further secured to the ground by a stake.

The devices described above do not uniformly provide optimal stabilization for commercial nursery use. Further, the device described in U.S. Pat. No. 1,902,423 requires that the ornamental pot be supported by support rods 34 for sufficient stabilization because the ring apparatus itself will not adequately function in this capacity. However, commercial nursery pots do not contain the handle shown in FIG. 1 of U.S. Pat. No. 1,902,423 for connection to support rods 34. Further, previous plant holding devices do not allow proper drainage and/or do not provide a sufficient air gap for root pruning, thus promoting penetration of roots into the ground and subsequent root damage when the plant is removed.

Thus, there is a need for a simple, inexpensive device for holding and supporting potted nursery plants so as to prevent blowover during windy and/or rainy conditions. The present invention addresses this need.

SUMMARY OF THE INVENTION

One embodiment of the present invention is a nursery pot stabilizing device, comprising a circular base having an upper surface, a lower surface and a central platform for receiving a nursery pot, the central platform having a plurality of openings therein; a plurality of vertical supports attached to and extending upwardly from the upper surface of the base, the vertical supports having distal ends opposite the base and surrounding the platform, the vertical supports and the base together forming a receptacle sized to receive and hold a nursery pot; and a plurality of openings in the base between the vertical supports. The device may further comprise a plurality of projections attached to and extending downwardly from the lower surface of the base. Preferably, the projections are triangular. In one aspect of this preferred embodiment, the vertical supports comprise lips near their distal ends and slots above the lips. The device may further comprise a support ring encircling the vertical supports, the ring having tabs attached thereto for engaging the slots. The device may further comprise a support ring encircling the receptacle and attached at or near the distal end of the vertical supports. Advantageously, the vertical supports are wider at the end attached to the upper surface of the base than at the end distal to the base. Preferably, the device is made of an injection molded polymer such as polyethylene. In another aspect of this preferred embodiment, the device comprises six vertical supports. Advantageously, the device comprises six openings in the base between the vertical supports. Preferably, the central platform is lower than the upper surface of the base. The device may further comprise a plurality of openings between the central platform and the base.

The present invention also provides a method of stabilizing a nursery pot comprising anchoring the device described above into the ground and placing the pot in the device.

DETAILED DESCRIPTION OF THE PREFERRED EMBODIMENTS

The present invention provides a simple, inexpensive, recyclable device for use in the nursery industry. The device holds and stabilizes nursery pots, preventing blowover due to wind and inclement weather. The device also prevents inadvertent toppling of potted plants, shrubs, trees and flowers due to contact with humans, animals or various objects. The nursery pot stabilizing device of the invention may be used for shrubs, trees, flowers and any other type of desired plant. Additional benefits of the device are that plants are elevated slightly off the ground, preventing roots from growing outside of the containers and into the ground. Also, the nursery pot stabilizers of the invention can remain in place, even though plants are moved or sold. This prevents the need to space new plants in the beds, since the stabilizers are already properly spaced.

The device can be manufactured to any desired size, although preferred sizes are those which will hold standard nursery pots of 1, 2, 5, 7, 10 and 15 gallons. The article is typically made of plastic, preferably polyethylene, most preferably high density polyethylene (HDPE). However, other materials are also contemplated including metals, polypropylene and polystyrene. Although high density polyethylene is preferred, the use of low density polyethylene, linear low density polyethylene and mixtures of high density/low density polyethylene are also contemplated. The device of the invention is a one piece article formed by standard injection molding procedures well known in the art. Briefly, high density polyethylene is melted, injected into a mold, allowed to cool and removed from the mold. Excess pieces of HDPE, if any, are trimmed and removed to yield the final product.

Figure 1:
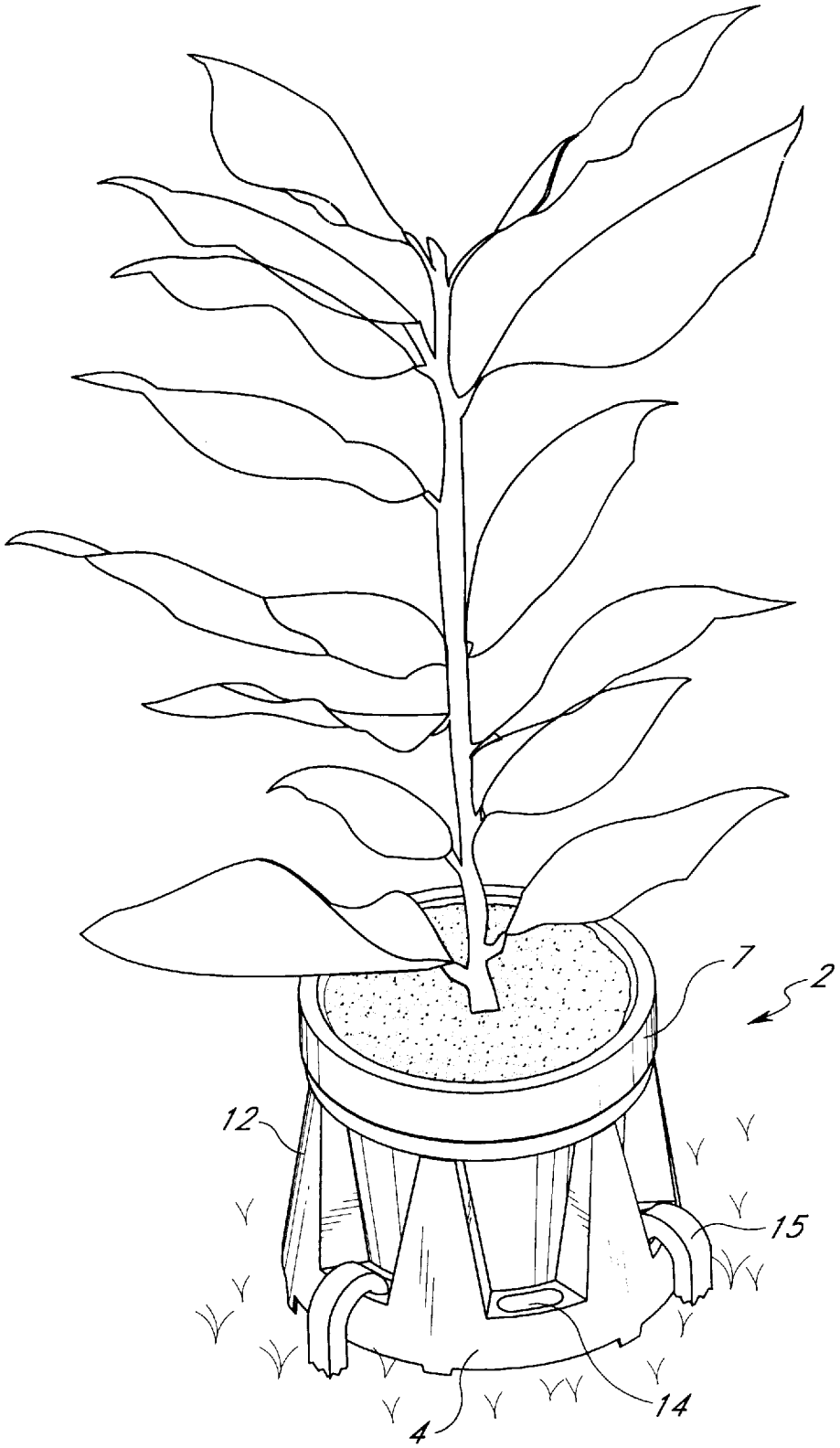
FIG. 1 is a side view of the nursery pot stabilizer of the invention containing a nursery plant and secured to the ground.
Figure 2:
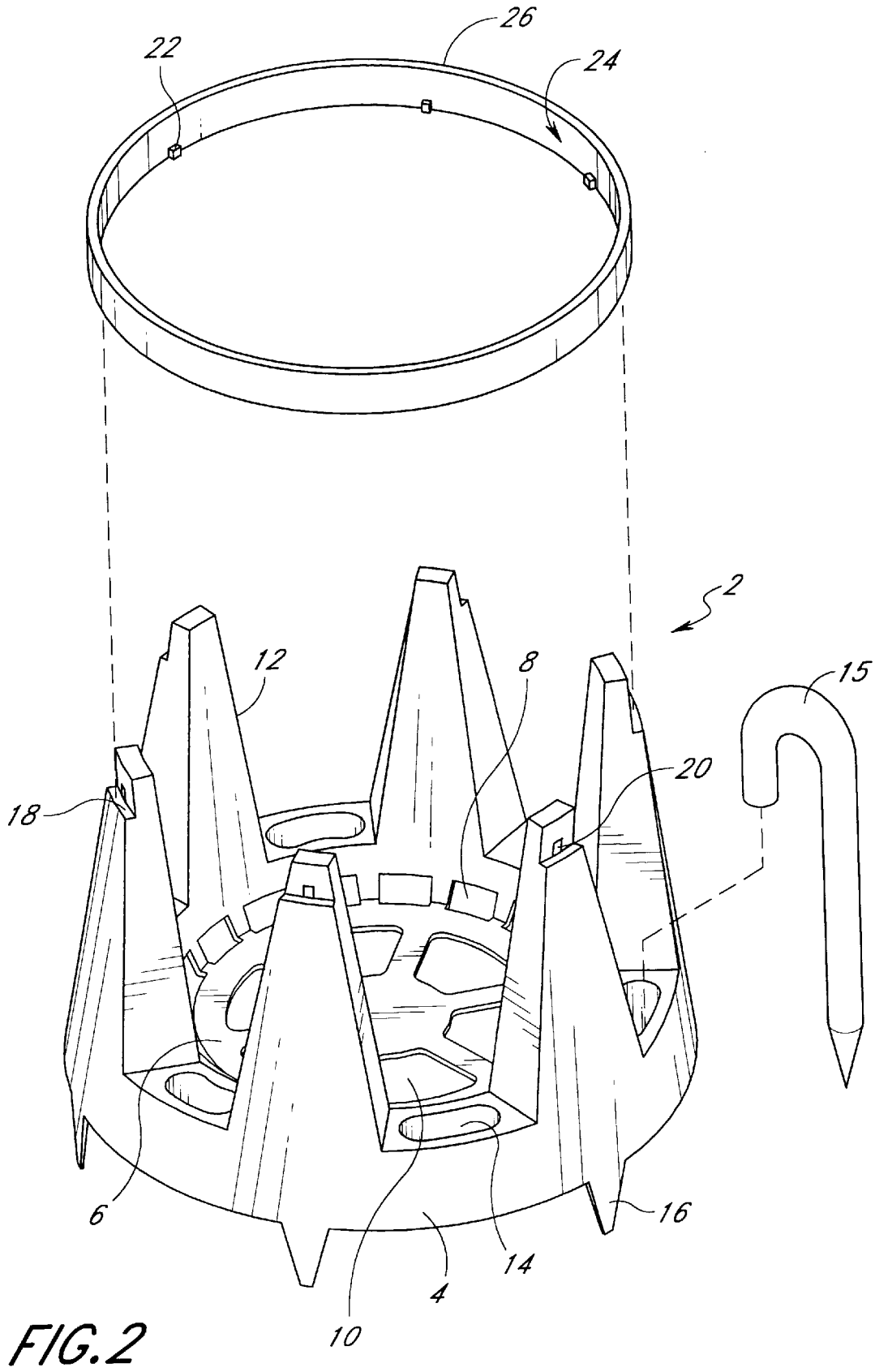
FIG. 2 is a side view of the nursery pot stabilizer of the invention which also shows the stabilizer ring and J-hook.

Referring to FIGS. 1 and 2, the nursery pot stabilizer 2 comprises a circular base 4 and a central platform 6 for receiving a nursery pot 7. The central platform 6 is encircled by the base 4 and attached thereto. In a preferred embodiment, the central platform 6 is at a level lower than the base 4. A plurality of openings 8 may be provided between the base and the central platform. These openings allow entry of air and light which inhibit root penetration into the ground upon which the device 2 is placed. The central platform 6 contains a plurality of openings 10 therein, allowing drainage of water from the nursery pot 7 placed thereon. One of such openings 10 may be in the center of the platform. This opening can be used for placement of a stake therethrough for stabilization of the device. A plurality of vertical supports 12 arranged in a generally circular configuration are attached to the upper surface of the base 4 and extend upwardly therefrom. The vertical supports 12 encircle the central platform 6 and contact and support the outer surface of the flower pot placed on the central platform 6. Although the vertical supports can be any desired shape, it is preferred that they be triangular, or at least that the ends distal to the base are narrower than the ends proximal to the base. The presence of between two and eight vertical supports is preferred. The use of four, five or six supports is particularly preferred. The base also contains a plurality of openings 14 extending through the base between the vertical supports for placement of one or more stakes therethrough. The stakes, such as J-hooks 15, anchor the device 2 to the ground and prevent blowover. Although the presence of any number of such openings between the vertical supports 12 is contemplated, the presence of one opening 14 between each vertical support member 12 is preferred. The device can be staked using at least one of the openings 14 between the vertical supports.

In another preferred embodiment of the invention, a plurality of downwardly extending projections 16 are attached to the lower surface of the base. Although these projections can be any desired shape, triangular projections are preferred. In another preferred embodiment, the projections 16 are narrower at the end distal to the base. These projections serve as additional stabilizers by penetrating the ground and anchoring the device thereto.

When the device is secured to the ground, central platform 6 is preferably suspended thereabove such that the bottom of the nursery pot does not contact the ground. This creates a gap which allows delivery of air and light to the roots growing out of the bottom of the pot. As mentioned hereinabove, because light and air inhibit root growth, this "air pruning" gap is a natural barrier to penetration of the root system into the ground. The growth of the root system of such potted plants into the ground is undesirable because the removal of these roots is difficult and may cause severe damage to the root system and the plant. Such damaged root systems may not allow subsequent transplantation.

In another embodiment of the invention, the vertical support members contain a lip 18 near the distal ends thereof. As used herein, the term "near" indicates within the third of the vertical support member 12 nearest the tip thereof. A slot 20 for receiving a tab is positioned just above each lip 18. As shown in FIG. 2, the slots 20 engage tabs 22 attached to the inner surface 24 of a ring 26. By way of such attachment, ring 26 encircles the distal end of vertical supports 12 and provides further stabilization by inwardly drawing vertical supports 12 resulting in the nursery pot being held more tightly.

While particular embodiments of the invention have been described in detail, it will be apparent to those skilled in the art that the disclosed embodiments may be modified. Therefore, the foregoing description is intended to be exemplary rather than limiting, and the true scope of the invention is that defined in the following claims.

What is claimed is:

1. A nursery pot stabilizing device, comprising:

a circular base having an upper surface, a lower surface, an outer periphery and a central platform for receiving a nursery pot, said central platform having a plurality of openings therein;

a plurality of vertical supports attached to and extending upwardly from the upper surface of said base, said vertical supports and said base together forming a receptacle sized to receive and hold a nursery pot; and a plurality of openings along the outer periphery and on the upper surface of said base between said vertical supports.

2. The device of claim 1, further comprising a plurality of projections attached to and extending downwardly from the lower surface of said base.

3. The device of claim 2, wherein said projections are triangular.

4. The device of claim 1, wherein said vertical supports comprise lips near the distal end thereof and slots above said lips.

5. The device of claim 4, further comprising a support ring encircling said vertical supports, said ring having tabs attached thereto for engaging said slots.

6. The device of claim 1, further comprising a ring encircling said receptacle and attached at or near the distal end of said vertical supports.

7. The device of claim 1, wherein said vertical supports are wider at the end attached to the upper surface of said base than at the end distal to said base.

8. The device of claim 1, wherein said device is made of polyethylene.

9. The device of claim 1, wherein said device comprises six vertical supports.

10. The device of claim 1, wherein said device comprises six openings in said base between said vertical supports.

11. The device of claim 1, wherein said central platform is lower than said upper surface of said base.

12. The device of claim 1, further comprising a plurality of openings between said central platform and said base.

13. A method of stabilizing a nursery pot comprising anchoring the device of claim 1 into the ground and placing said pot therein.

* * * * *